US009917358B1

(12) United States Patent
Albers

(10) Patent No.: US 9,917,358 B1
(45) Date of Patent: Mar. 13, 2018

(54) ARRAY ANTENNA WITH TIGHTLY COUPLED ELEMENTS

(71) Applicant: Ball Aerospace & Technologies Corp., Boulder, CO (US)

(72) Inventor: Luke J. Albers, Westminster, CO (US)

(73) Assignee: BALL AEROSPACE & TECHNOLOGIES CORP., Boulder, CO (US)

( * ) Notice: Subject to any disclaimer, the term of this patent is extended or adjusted under 35 U.S.C. 154(b) by 207 days.

(21) Appl. No.: 14/280,392

(22) Filed: May 16, 2014

Related U.S. Application Data

(60) Provisional application No. 61/824,833, filed on May 17, 2013.

(51) Int. Cl.
*H01Q 21/08* (2006.01)
*H01Q 1/50* (2006.01)
*H01Q 21/00* (2006.01)

(52) U.S. Cl.
CPC ..... *H01Q 1/50* (2013.01); *H01Q 21/0087* (2013.01)

(58) Field of Classification Search
CPC ..... H01Q 21/062; H01Q 1/38; H01Q 11/04; H01Q 9/16
USPC ..... 343/824, 905, 850, 793
See application file for complete search history.

(56) References Cited

U.S. PATENT DOCUMENTS

2004/0056805 A1* 3/2004 Chen ..... H01Q 1/243 343/700 MS
2009/0213024 A1* 8/2009 Hsieh ..... H01Q 1/38 343/795
2012/0169561 A1* 7/2012 Bin Basri ..... H01Q 21/12 343/814

* cited by examiner

*Primary Examiner* — Dameon E Levi
*Assistant Examiner* — Collin Dawkins
(74) *Attorney, Agent, or Firm* — Sheridan Ross P.C.

(57) ABSTRACT

An antenna with tightly coupled elements is provided. The antenna includes a plurality of planar elements. Each element is connected to a signal line, and is coupled to at least one other element. The elements are arranged in one or more linear arrays. A first array of elements can be provided on a first plane, while a second array of elements can be provided on a second plane. Moreover, elements included in the first array can can at least partially overlap elements included in the second array. Alternatively, a single array of elements formed on a first plane can be provided, with coupling elements that are capacitively connected to one element, and directly, are electrically connected to an adjacent element.

16 Claims, 6 Drawing Sheets

ARRAY ANTENNA WITH TIGHTLY COUPLED ELEMENTS

CROSS-REFERENCE TO RELATED APPLICATIONS

The present application claims the benefit of U.S. Provisional Patent Application Ser. No. 61/824,833, filed May 17, 2013, the entire content of which is hereby incorporated herein by reference.

FIELD

The present disclosure provides an array antenna with tightly coupled elements. More particularly, a linear array of coupled elements is provided.

BACKGROUND

In various applications, a broadband antenna that can be integrated into a vehicle or other structure is required. For example, a broadband antenna for integration into the vertical stabilizer of an aircraft must essentially be a two-dimensional structure. This creates challenges for the antenna designer, particularly in view of the broad bandwidth requirements that may also apply.

In order to provide broadband performance in an essentially two-dimensional structure, previous designs have utilized dipole elements on one side of a substrate, with capacitive feed structures on the opposite side of the substrate. In such designs, coupling between dipoles is achieved through edge coupling. This requires extremely small gaps, a very thin substrate, dipole elements that are open in the center, and precision manufacturing techniques. Accordingly, such designs can be expensive to produce. In addition, the efficiency of such designs may be less than desired.

SUMMARY

In accordance with embodiments of the present disclosure, an antenna is provided in which a radiating conductor or radiating element of a unit cell or dipole is interleaved or overlaps with a radiating conductor or a radiating element of another dipole. As a result, coupling between the elements of unit cells or dipoles is increased as compared to previous designs. In addition, the improved coupling performance allows for the use of practical materials and practical circuit layouts. In particular, the arrangement increases the capacitance between the radiating conductors, thereby increasing the coupling. This makes the design of the antenna much simpler, with more easily produced structures and circuit layouts. In addition to increased producibility, improved performance can also be realized due to the added degrees of freedom given to the designer. For example, at least some embodiments of the present disclosure exhibit usable bandwidth in excess of 30:1, occupy a very small volume, handle large radio frequency (RF) power levels, have all power dividing circuitry integrated, and provide an omni-directional radiation pattern.

In accordance with other embodiments of the present disclosure, an antenna is provided in which radiating conductors are provided in an array formed on one side of a substrate. In such embodiments, each radiating conductor is directly electrically connected to a ground signal conductor at or towards a first side of the radiating conductor, and is directly electrically connected to a primary signal conductor at or towards a second side of the radiating conductor. Moreover, the primary signal conductor follows a path that is adjacent the ground signal conductor for a first radiating conductor, before turning to directly connect to a second radiating conductor adjacent the first radiating conductor.

Additional features and advantages of the present invention will become more readily apparent from the following description, particularly when taken together with the accompanying drawings.

DETAILED DESCRIPTION

Figure 1A:
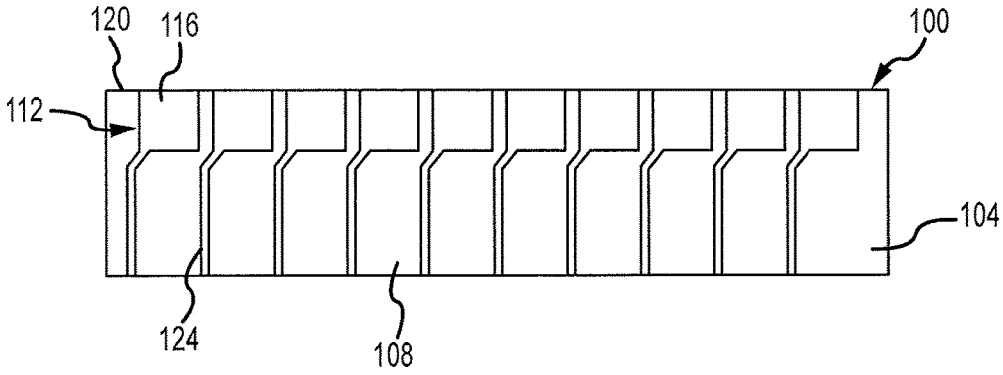
FIG. 1A depicts a first side elevational view of an antenna in accordance with embodiments of the present disclosure.

FIG. 1A depicts an antenna 100 in accordance with embodiments of the present disclosure. More particularly, FIG. 1A depicts a first side 104 of the antenna 100. The antenna 100 generally includes an antenna substrate 108. A first linear array of elements 112 is located on the first side 104 of the antenna substrate 108. The first linear array 112 includes a plurality of radiating conductors or radiating elements (hereinafter "radiating conductors") 116 located along or adjacent a first edge 120 of the antenna substrate 108. Each of the radiating conductors 116 is fed by a signal line conductor 124. In the embodiment depicted in FIG. 1A, the signal line conductor 124 may comprise a trace or strip line mounted and/or formed on the first surface 104 of the antenna substrate 108, and each signal line conductor 124 may be integral to an associated radiating conductor 116. Alternatively or in addition, the signal line conductor 124 may be internal to the substrate 108, for example where the substrate 108 comprises a printed circuit board or other multilayer circuit board. In accordance with still other embodiments, the signal line conductor 124 may comprise a coaxial conductor or wire.

Figure 1B:
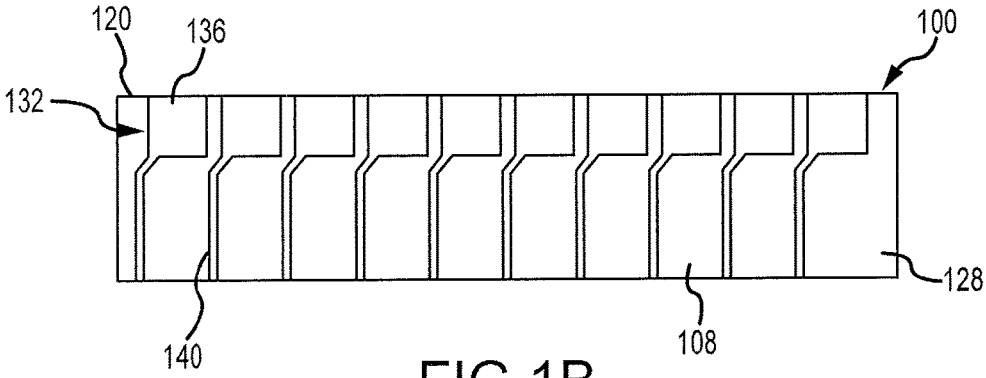
FIG. 1B depicts a second side elevational view of the antenna of FIG. 1A.

FIG. 1B illustrates a second side 128 of the antenna 100 shown in FIG. 1A. In general, it can be seen that the second side 128 includes a second linear array 132 that includes a plurality of radiating conductors or radiating elements 136.

In general, the radiating conductors 136 included in the second array 132 can be the same or a similar size as the radiating conductors 116 of the first array 112. Moreover, the radiating conductors 116 and 136 of the first 112 and second 132 arrays can be aligned with one another, such that each radiating conductor 116 overlaps a radiating conductor 136. Each radiating conductor 136 included in the second array 132 is electrically connected to a signal line conductor 140. Moreover, the signal line conductors 140 on the second side 128 of the antenna 100 may be configured such that they overlap the conductors 124 on the first side 104 of the antenna 100. In accordance with still other embodiments, the arrays 112 and 132 may be offset such that one radiating conductor 116 and 136 of each array 112 and 132 does not overlap or only partially overlaps a radiating conductor 136 and 116 of the other array 132 and 112.

Figure 1C:
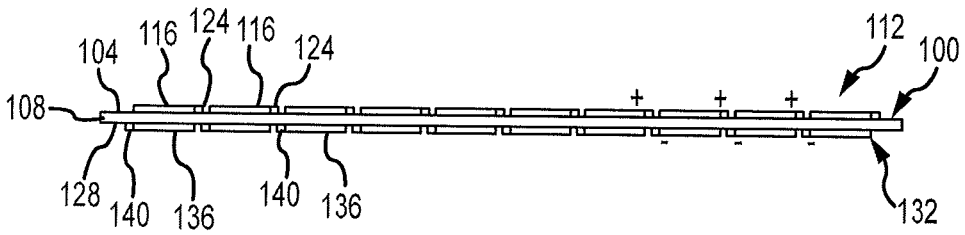
FIG. 1C is a top plan view of the antenna of FIGS. 1A and 1B.

FIG. 1C illustrates the antenna 100 of FIGS. 1A and 1B in a view taken perpendicular to the top edge 120. In the figure, the thicknesses of the radiating conductors 116 and 136, and the substrate 108, have been exaggerated, and are not to scale, in order to more clearly show those elements. As seen in FIG. 1C, the arrays 112 and 132, and their constituent radiating conductors 116 and 136 can be aligned with one another, on opposite sides of the antenna substrate 108, such that they entirely or almost entirely overlap one another.

Figure 1D:
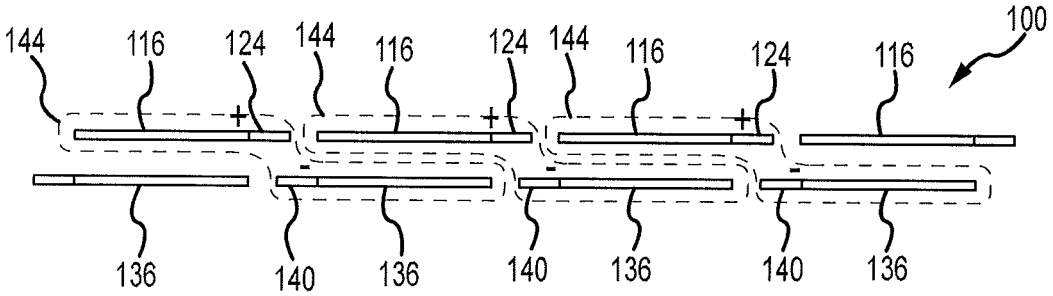
FIG. 1D depicts the electrical field and dipole configuration of the antenna of FIGS. 1A-1C.

With reference now to FIG. 1D, the relationship between radiating conductors 116 and 136, shown in a top end view (from the same direction as in FIG. 1C) in an exemplary embodiment of the present invention is shown. More particularly, dipoles 144 formed between pairs of radiating conductors 116 and 136 are depicted. As shown, adjacent dipoles 144 each include a radiating conductor 116 or 136 that overlaps with at least one other radiating conductor 116 or 136. Moreover, the radiating conductors 116 and 136 of overlapping pairs are each associated with different dipoles. Alternatively, the radiating conductors 116 and 136 of overlapping pairs or dipoles can only partially overlap. For an end radiating conductor 116 and 136, at least one of the radiating conductors 116 or 136 is not associated with any dipole. As a result of the overlap between radiating conductors 116 and 136, the capacitive coupling between dipoles 144 is relatively high. In addition, the signals that are provided by the conductors 124 and 140 are shown. In this embodiment, where the radiating conductors 116 and 136 in any one dipole 144 are on different sides of the substrate 108, all the radiating conductors 116 in the first array 112 can be provided with a + signal, and all the radiating conductors 136 in the second array 132 can be provided with a − signal by an associated signal line conductor 124 or 140. As can be appreciated by one of skill in the art after consideration of the present disclosure, different elements or sets of elements 116, 136 can be provided with signals associated with different frequencies or frequency ranges. In this illustrated configuration, the conductors 124 and 140 comprise traces or conductive strips on the surfaces 104 and 128 of the substrate 108 that overlap one another, to create a twin lead feed configuration.

Figure 2A:
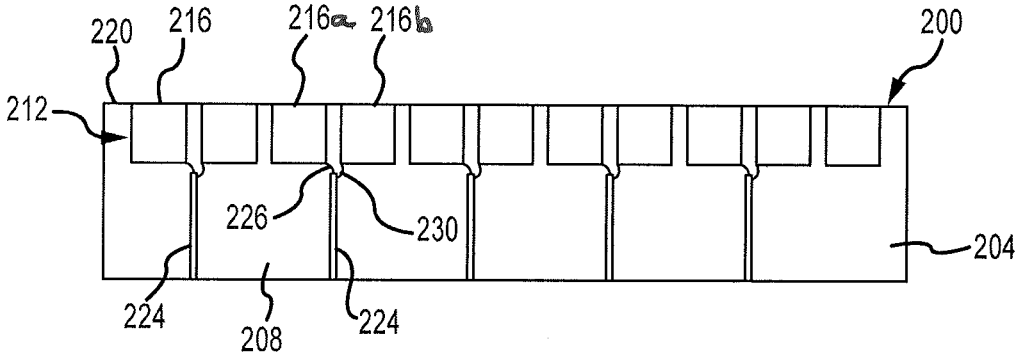
FIG. 2A depicts a first side elevational view of an antenna in accordance with other embodiments of the present disclosure.

FIG. 2A depicts an antenna 200 in accordance with other embodiments of the present disclosure. More particularly, FIG. 2A depicts a first side 204 of the antenna 200. In general, the antenna 200 is similar to the antenna 100, except that, while the antenna 100 features an "interleaved" arrangement of dipole elements, the antenna 200 features dipole elements that overlap one another, with each pair of elements in any one dipole on one side of a substrate 208. A first linear array of elements 212 includes a plurality of radiating elements or radiating conductors 216 located along or adjacent a first edge 220 of the antenna substrate 208. The radiating conductors 216 are fed by a signal line conductor 224. In the embodiment depicted in FIG. 2A, the signal line conductor 224 may comprise a coaxial wire, with a center conductor 226 electrically connected to a first one of the radiating conductors 216*a* in a dipole, and the ground or shield wire 230 connected to a second one of the radiating conductors 216*b* in the dipole. Alternatively or in addition, the signal line conductor 224 may comprise a trace or strip line.

Figure 2B:
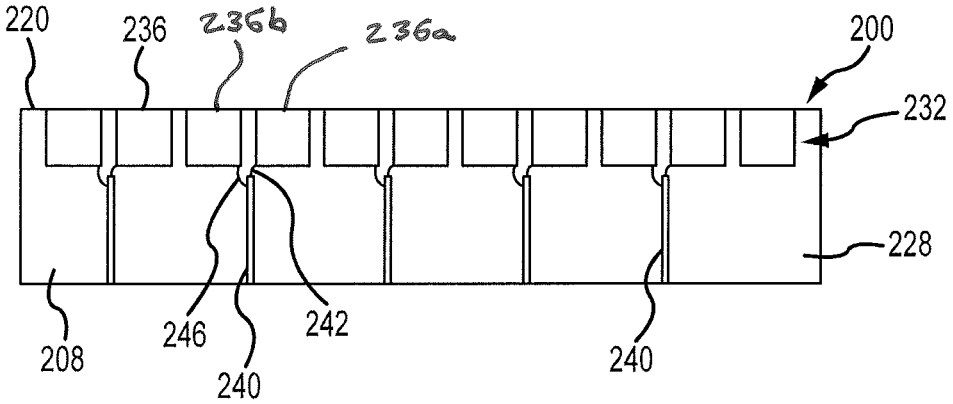
FIG. 2B depicts a second side elevational view of the antenna of FIG. 2A.

FIG. 2B illustrates a second side 228 of the antenna 200 shown in FIG. 2A. A second linear array 232 containing a plurality of radiating conductors or elements 236 is located on the second side 228. The radiating conductors 236 are fed by a signal line conductor 240. The signal line conductor 240 may comprise a coaxial wire with a center conductor 242 electrically connected to a first one of the radiating conductors 236*a* in a dipole, and the ground or shield wire 246 connected to a second one of the radiating conductors 236*b* in a dipole. The radiating conductors 236 included in the second array 232 can be the same or a similar size as the radiating conductors 216 of the first array 212. Moreover, the radiating conductors 216 and 236 of the first 212 and second 232 arrays can be aligned with one another, such that each radiating conductors 216 in the first array 212 overlaps a radiating conductor 236 in the second array 232. In accordance with still other embodiments, the arrays 212 and 232 may be offset such that one radiating conductors 216 and 236 of each array 212 and 232 does not overlap or only partially overlaps a radiating conductor 236 and 216 of the other array 232 and 212.

Figure 2C:
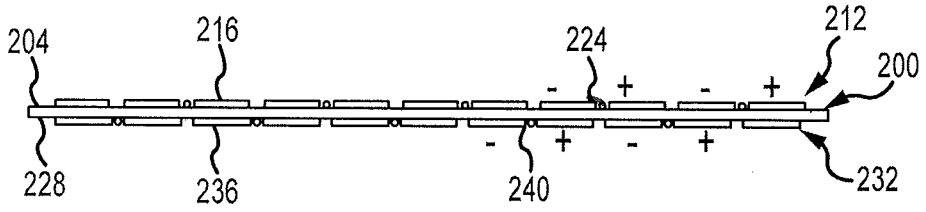
FIG. 2C is a top plan view of the antenna of FIGS. 2A and 2B.

FIG. 2C illustrates the antenna 200 of FIGS. 2A and 2B in a view taken perpendicular to the top edge 220. In the figure, the thicknesses of the radiating conductors 216 and 236, and the substrate 208, have been exaggerated, and are not to scale, in order to more clearly show those elements. As seen in FIG. 2C, the arrays 212 and 232, and their constituent radiating conductors 216 and 236 can be aligned with one another, on opposite sides of the antenna substrate. Moreover, as depicted, the signals supplied to the radiating conductors 216 and 236 by the respective conductors 224 and 240 can be arranged such that a first (depicted as positive) signal and a second signal (depicted in the figure as negative) are provided in an alternating fashion to the radiating conductors 216 or 236 in an array 212 and 232, and such that overlapping radiating conductors 216 and 236 receive appropriate signals.

Figure 2D:
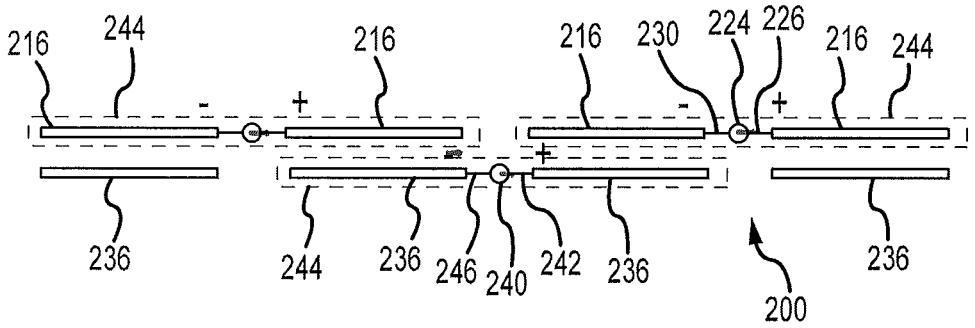
FIG. 2D depicts the electrical field and dipole configuration of the antenna of FIGS. 2A-2C.

With reference now to FIG. 2D, the relationship between radiating conductors 216 and 236, shown in a top end view (from the same direction as in FIG. 2C) in an exemplary embodiment of the present invention is depicted. More particularly, dipoles 244 formed between pairs of radiating conductors 216 and 236 are shown. As depicted, the radiating conductors 216 or 236 within the arrays 212 and 232 are provided with alternating signals by associated conductors 224 or 240. Moreover where, as in the illustrated example, the conductors 224 and 240 are coaxial conductors, the center conductor 226, 242 is shown as supplying a + signal, and the outer conductor is shown as supplying a − signal. Moreover, an element 216 or 236 within a dipole 244 overlaps with an radiating conductor 236 or 216 of a dipole 244 on the second side 228 that is fed with the opposite signal.

Figure 3A:
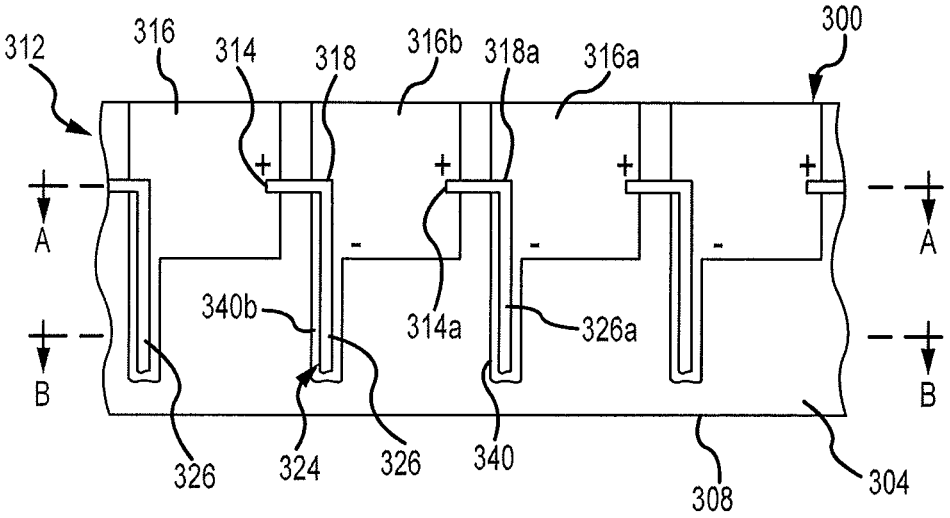
FIG. 3A depicts a first side elevational view of an antenna in accordance with other embodiments of the present disclosure.

FIG. 3A depicts an antenna 300 in accordance with still other embodiments of the present disclosure from a first side 304. In this embodiment, all of the radiating conductors or radiating elements 316 are formed on one side of the substrate 308, as part of a single linear array 312. In addition, a balan or coupling element 318 is provided. More particularly, the coupling element 318 may comprise an extension of a trace, stripline, or other primary conductor 326 provided as part of a signal line conductor 324. In the figure, a substrate or insulator layer 304 (see also FIGS. 3C and 3D) that lies between the radiating conductors 316 and the primary conductor 326 portions of the signal line conductors 324 has been omitted (or depicted as transparent), in order to illustrate the relationship between those components. The primary conductor 326 is positioned within a plane that is parallel to and spaced apart from the plane in which the radiating conductors 316 are formed. Moreover, a portion of the primary conductor 326 can overlap with a portion of a radiating conductor 316. The coupling element 318 can be integral and/or electrically connected to the primary conductor 326, and extends from a location overlapping the radiating conductor 316 with which the primary conductor 326 overlaps to a location overlapping an adjacent radiating conductor 316. Moreover, an end of the coupling element 318 can be connected to the adjacent radiating conductor 316 by an associated via 314, or by an extension of the coupling element, to electrically connect the adjacent radiating conductor 316 to the primary conductor 326. The signal line conductor 324 can additionally include a first ground or shield conductor 340 that is paired with the primary signal line conductor 326. Accordingly, the primary conductor 326 can supply a + signal, and the first ground conductor 340 can supply a − signal. As shown in this example, the first ground conductor 340 can extend from and/or be integral to an associated radiating conductor 316, and is located in the same plane as the radiating conductor 316.

For example, as shown in FIG. 3A, a primary conductor 326*a* at least partially overlaps a first radiating conductor 316*a*, and that first primary conductor 326*a* is connected to a second radiating conductor 316*b*, adjacent the first radiating conductor 316*a*, by a via 314*a* that extends from the coupling element 318*a*. In addition, the coupling element 318*a* can directly connect to the second radiating conductor 316*b* at or towards a side of the second radiating conductor 316*b* that is opposite the side of the second radiating conductor 316*b* at or towards which a first ground conductor 340*b* joins and is connected to the second radiating conductor 316*b*. Accordingly, each radiating conductor 316 is provided with a first signal (e.g., a + signal), by an associated via 314, coupling element 318 and primary conductor 326 at or towards a first side of the radiating conductor 316, and is provided with a second signal (e.g., a − signal) by an associated ground conductor 340 at or towards a second side of the radiating element 316.

Figure 3B:
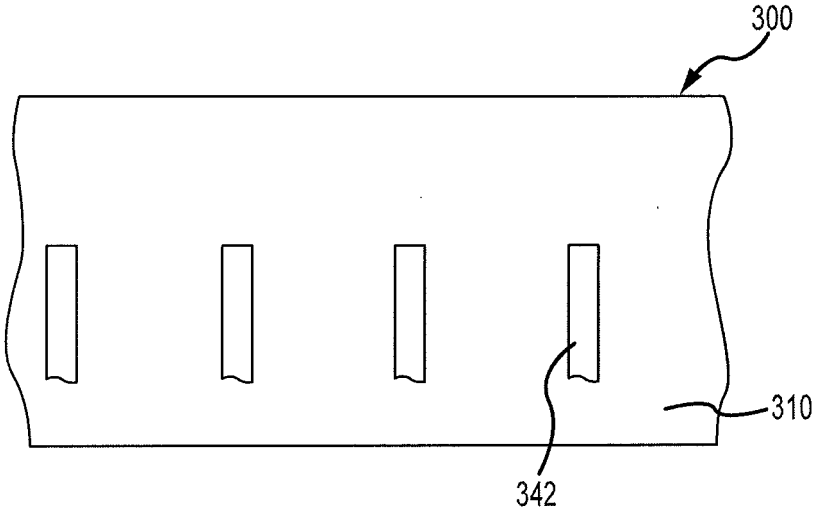
FIG. 3B depicts a second side elevational view of the antenna of FIG. 3A.

As shown in FIG. 3B, a second ground conductor 342 can also be provided. The second ground conductor 342 overlaps the primary conductor 326, and that is located on a side of the primary conductor 326 opposite the side of the primary conductor 326 on which the first ground conductor 340 is located. Moreover, the second ground conductor 342 is positioned within a plane that is parallel to and spaced apart from the plane containing the primary conductor 326. For example, as shown in FIGS. 3B and 3D, the second ground conductors 342 can be formed on a substrate or insulator layer 310 that lies between the primary conductors 326 and the second ground conductors 342.

Figure 3C:
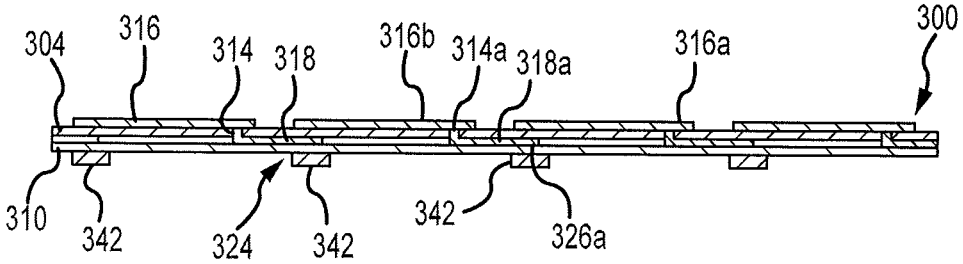
FIG. 3C is a top plan view of the antenna of FIGS. 3A and 3B taken along section line A-A.

FIG. 3C is a cross-section of the antenna 300, taken along section line A-A in FIG. 3A. In FIG. 3C (and also in FIGS. 3D and 3E) the thickness of various features, including the radiating conductors 316, the coupling elements 318, the primary conductors 326, the first and second ground conductors 340 and 342, and the layers 304 and 310 have been exaggerated, and are not scale, in order to more clearly show those elements. As shown, the coupling elements 318 can comprise extensions of the primary signal line conductors 326 and a via 314 that extends through the substrate 304 to electrically connect the primary signal line conductor 326 to a radiating conductor 316.

Figure 3D:
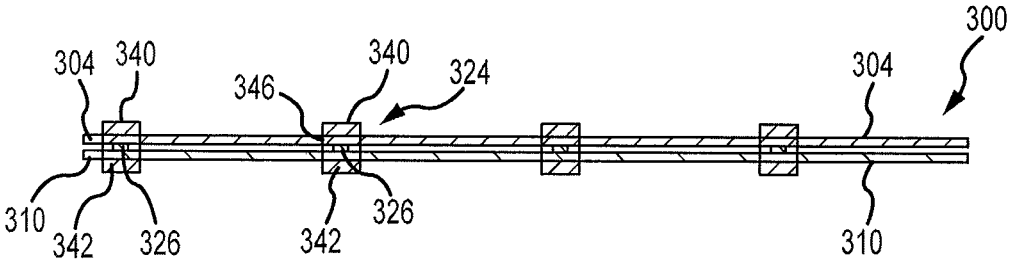
FIG. 3D is a top plan view of the antenna of FIGS. 3A and 3B taken along section line B-B.

FIG. 3D is a cross-section of the antenna 300, taken along section line B-B in FIG. 3A. As shown in this figure, each first ground conductor 340 is paired with a second ground conductor 342, to effectively surround or shield an associated primary conductor 326. Moreover, the first 340 and second 342 ground conductors within a pair can be electrically connected to one another, for example by a series of vias 346 located at intervals along the length of the respective and ground conductors 340 and 342.

Figure 3E:
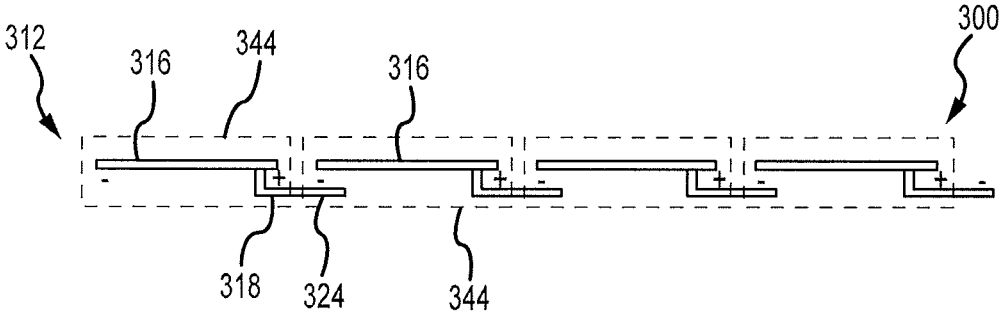
FIG. 3E depicts the electrical field and dipole configuration of the antenna of FIGS. 3A-3D.

The relationship between radiating conductors 316, shown in a top end view (from the same direction as in FIGS. 3C and 3D) of the antenna 300 is depicted in FIG. 3E. The signals supplied to the radiating conductors 316 by the respective signal line conductors 324 are also depicted, with the signals provided by the primary signal line conductors 326 shown with a + and the ground conductors 340 and 342 shown with a −. As can be appreciated from the figure, in this embodiment each individual radiating conductor 316 can have both + and − regions thereon. Accordingly, each individual radiator conductor operates as a dipole 344. Moreover, adjacent radiating conductors 316 are capacitively coupled to one another by the signal line, and capacitance between radiating conductors 316 is promoted by placing the radiating conductor 316 in a single plane.

In accordance with further embodiments, methods for providing an antenna are disclosed. The methods include providing a plurality of radiating conductors in at least a first plane. In at least some embodiments, a single array of radiating conductors is provided, and each radiating conductor in the plurality of radiating conductors is supplied with signals of first (e.g. +) and second (e.g. −) types. In other embodiments, the radiating conductors are provided in first and second arrays. Each conductor in each array is supplied with a signal of either a first (e.g. +) or second (e.g. −) types. In addition, each radiating conductor in the first array supplied with a signal of the first type overlaps a radiating conductor in the second array supplied with a signal of the second type. Correspondingly, each radiating conductor in the first array supplied with a signal of the second type overlaps a radiating conductor in the second array supplied with a signal of the first type. In such embodiments, a signal line conductor can supply a signal of the first type to a radiating conductor in the first array and a signal of the second type to a radiating conductor in the second array. Alternatively, each signal line conductor can provide a signal of a first type to a radiating conductor in either the first or second array, and can provide a signal of a second type to a second radiating conductor in the same array as the first radiating conductor. In addition, the signals provided to different groups of radiating conductors can be of different frequencies.

The foregoing discussion of the invention has been presented for purposes of illustration and description. Further, the description is not intended to limit the invention to the form disclosed herein. Consequently, variations and modifications commensurate with the above teachings, within the skill or knowledge of the relevant art, are within the scope of the present invention. The embodiments described hereinabove are further intended to explain the best mode presently known of practicing the invention and to enable others skilled in the art to utilize the invention in such or in other embodiments and with various modifications required by the particular application or use of the invention. It is intended that the appended claims be construed to include alternative embodiments to the extent permitted by the prior art.

What is claimed is:

1. An antenna, comprising:

an antenna substrate;

a plurality of signal line conductors;

a first plurality of elements, wherein each element in the first plurality of elements is located on a first side of the antenna substrate, and wherein each element in the first plurality of elements is electrically interconnected to a signal line conductor included in the plurality of signal line conductors and located on the first side of the antenna substrate;

a second plurality of elements, wherein each element in the second plurality of elements is located on a second side of the antenna substrate, and wherein each element in the second plurality of elements is electrically interconnected to a signal line conductor included in the plurality of signal line conductors and located on the second side of the antenna substrate, wherein each element in the first plurality of elements forms a dipole with another element in one of the first and second plurality of elements, wherein a plurality of dipoles are formed, wherein for any one of the dipoles a first element of the one dipole does not overlap a second element of the one dipole, wherein the first and second pluralities of elements are located along a first edge of the antenna substrate, and wherein the signal line conductors extend from the first and second pluralities of elements to a second edge of the antenna substrate.

2. The antenna of claim 1, wherein a first element of a first dipole of the plurality of dipoles overlaps a second element of a second dipole of the plurality of dipoles.

3. The antenna of claim 2, wherein a second element of the first dipole overlaps a first element of a third dipole of the plurality of dipoles.

4. The antenna of claim 1, wherein a first element of the first dipole overlaps a second element of the second dipole.

5. An antenna, comprising:

an antenna substrate;

a plurality of signal line conductors;

a first plurality of elements, wherein each element in the first plurality of elements is located on a first side of the antenna substrate, and wherein each element in the first plurality of elements is electrically interconnected to a signal line conductor included in the plurality of signal line conductors and located on the first side of the antenna substrate; and a second plurality of elements, wherein each element in the second plurality of elements is located on a second side of the antenna substrate, and wherein each element in the second plurality of elements is electrically interconnected to a signal line conductor included in the plurality of signal line conductors and located on the second side of the antenna substrate, wherein each element in the first plurality of elements forms a dipole with another element in one of the first and second plurality of elements, wherein a plurality of dipoles are formed, wherein an element of a first dipole on the first side of the antenna substrate overlaps an element of a second dipole on the second side of the antenna substrate, wherein a first element of the first dipole overlaps a second element of the second dipole, and wherein a second element of the first dipole overlaps a first element of a third dipole.

6. The antenna of claim 5, wherein, for any one of the dipoles, a first element of the one dipole does not overlap a second element of the one dipole.

7. The antenna of claim 6, wherein for any one of the dipoles included in the plurality of dipoles each element is on one side of the antenna substrate.

8. The antenna of claim 6, wherein for any one of the dipoles included in the plurality of dipoles each element is on a different side of the antenna substrate.

9. The antenna of claim 6, wherein the plurality of signal line conductors includes traces.

10. The antenna of claim 6, wherein the plurality of signal line conductors includes coaxial conductors.

11. The antenna of claim 6, wherein the first and second pluralities of elements are located along a first edge of the antenna substrate.

12. The antenna of claim 5, wherein the signal line conductors are strip lines that are each integral to an element.

13. The antenna of claim 12, wherein the elements of any one dipole pair are on different sides of the antenna substrate.

14. The antenna of claim 5, wherein the signal line conductors are coaxial conductors.

15. The antenna of claim 14, wherein a center conductor of one of the coaxial conductors is connected to a first element of a first dipole, and wherein a shield wire of the one of the coaxial conductors is connected to a second element of the first dipole.

16. The antenna of claim 15, wherein the elements of the first dipole are on the first side of the antenna substrate, and wherein the elements of the second dipole are on the second side of the antenna substrate.

* * * * *